US009885215B2

(12) United States Patent
Delmar et al.

(10) Patent No.: US 9,885,215 B2
(45) Date of Patent: Feb. 6, 2018

(54) CORE BARREL AND RELATED DRILLING APPARATUS AND METHOD

(71) Applicants: Ludovic Delmar, Braine-l'Alleud (BE); Olivier Jean-Marc Claude Mageren, Brussels (BE); Eric Fannes, Braine-l'Alleud (BE)

(72) Inventors: Ludovic Delmar, Braine-l'Alleud (BE); Olivier Jean-Marc Claude Mageren, Brussels (BE); Eric Fannes, Braine-l'Alleud (BE)

(73) Assignee: Halliburton Energy Services, Inc., Houston, TX (US)

( * ) Notice: Subject to any disclaimer, the term of this patent is extended or adjusted under 35 U.S.C. 154(b) by 231 days.

(21) Appl. No.: 14/627,558

(22) Filed: Feb. 20, 2015

(65) Prior Publication Data

US 2015/0226016 A1 Aug. 13, 2015

Related U.S. Application Data

(63) Continuation of application No. 13/382,753, filed as application No. PCT/EP2010/059845 on Jul. 8, 2010, now abandoned.

(Continued)

(51) Int. Cl.
*E21B 10/02* (2006.01)
*E21B 17/042* (2006.01)

(Continued)

(52) U.S. Cl.
CPC ..... *E21B 17/042* (2013.01); *E21B 10/02* (2013.01); *E21B 17/043* (2013.01); *E21B 17/18* (2013.01);

(Continued)

(58) Field of Classification Search
CPC ..... E21B 10/02; E21B 17/042; E21B 17/043; E21B 17/046; E21B 17/07; E21B 25/00
See application file for complete search history.

(56) References Cited

U.S. PATENT DOCUMENTS 178,245 A 6/1876 Lickiss
886,083 A 4/1908 Smith (Continued)

OTHER PUBLICATIONS

International Search Report and Written Opinion, Application No. PCT/US2010/059845, 14 pages, dated Mar. 24, 2011.

(Continued)

*Primary Examiner* — Cathleen Hutchins
(74) *Attorney, Agent, or Firm* — Baker Botts L.L.P.

(57) ABSTRACT

There is disclosed herein drilling apparatus, in particular for use in the field of oil prospecting, comprising: a first tubular member (1, 2, 3); a second tubular member (6, 7, 8, 9) mounted at least partly within the first tubular member so as to be reciprocally free in rotation with respect to the first tubular member about an axis (5); and a drill bit (4) operatively connected to one of the first or second tubular members so as to be rotated in response to the one tubular member being turned in order to effect drilling, characterized in that: the drilling apparatus further comprises a restoring member (18, 36) for applying a forces between the first tubular member and the second tubular member at least in respective first axial directions in response to relative displacement of the first tubular member and the second tubular member in the respective opposite axial directions. Also provided are a tubular assembly and a method of assembling tubular members.

14 Claims, 6 Drawing Sheets

Related U.S. Application Data

(60) Provisional application No. 61/223,940, filed on Jul. 8, 2009.

(51) Int. Cl.

| | |
|---|---|
| ***E21B 17/043*** | (2006.01) |
| ***E21B 17/046*** | (2006.01) |
| ***E21B 17/07*** | (2006.01) |
| ***E21B 25/00*** | (2006.01) |
| ***E21B 17/18*** | (2006.01) |
| ***E21B 19/16*** | (2006.01) |
| ***E21B 25/16*** | (2006.01) |

(52) U.S. Cl.
CPC ..... *E21B 19/16* (2013.01); *E21B 25/00* (2013.01); *E21B 25/16* (2013.01); *Y10T 29/49881* (2015.01)

(56) References Cited

U.S. PATENT DOCUMENTS

| | | | | | |
|---|---|---|---|---|---|
| 1,305,009 | A | | 5/1919 | Robertson | |
| 2,128,914 | A | | 9/1938 | Burke et al. | |
| 2,403,002 | A | * | 7/1946 | Johnson | E21B 25/00 175/210 |
| 3,012,622 | A | * | 12/1961 | Austin | E21B 25/06 175/226 |
| 3,294,141 | A | * | 12/1966 | Schotthoefer | F16B 39/10 384/562 |
| 4,930,587 | A | | 6/1990 | Young et al. | |

OTHER PUBLICATIONS

Office Action issued in Chinese Patent Appl. No. 201080038771.X; 10 pages, dated Jan. 13, 2015.

* cited by examiner

CORE BARREL AND RELATED DRILLING APPARATUS AND METHOD

CROSS REFERENCE TO RELATED APPLICATIONS

This application is a continuation application of U.S. patent application Ser. No. 13/382,753 filed Jan. 6, 2012, which is a U.S. National Stage Application of International Application No. PCT/EP2010/059845 filed Jul. 8, 2010, which designates the United States and claims benefit under 35 U.S.C. § 119(e) of U.S. Provisional Application Ser. No. 61/223,940 filed Jul. 8, 2009, which are incorporated herein by reference in their entirety.

The present invention relates to drilling apparatus. The invention may find particular application in a core barrel, in particular for use in the field of oil prospecting, comprising

- at least one outer tube and a core bit which form an outer assembly,
- at least one inner tube and core removal elements which form an inner assembly, and
- a holder for holding the inner assembly in the outer assembly which comprise at least one rolling bearing arranged between them so that these assemblies are reciprocally free in rotation.

In a customary core barrel, the outer assembly is driven in rotation and the core bit can therefore dig a core hole. During this time, the inner assembly is held inside the outer assembly in a position fixed in terms of rotation, while being driven axially by the outer assembly.

Core barrels may be made to pass through geological layers, thereby generating very high levels of vibration in the core drilling equipment. Often, the tools that exist on the market do not withstand these extreme conditions. This is because the axial vibrations increase the risks of jamming of the system for holding the inner assembly inside the outer assembly. They may also cause damage to the numerous threads which are usually used to join together the outer assembly and inner assembly. Finally, these axial vibrations often have the effect of modifying the axial position of the inner assembly relative to the outer assembly whereas, in order for the core to be removed correctly, it is desirable that the respective depth positions of the core bit and of the core removal elements are appropriately adjusted.

It would be desirable to develop a core barrel in which these above-described vibrations which damage the threads are greatly reduced. It would also be desirable to considerably simplify the core drilling equipment and to reduce as far as possible the number of threads and also the number of parts. Finally, it would also be desirable to lock the system for adjusting the axial position of the inner assembly in the outer assembly, so as to prevent any disconnection between these once this position has been adjusted.

The present invention has been made in view of the foregoing background. A drilling apparatus according to a first aspect of the present invention is defined in claim 1 below.

In one embodiment, the drilling apparatus is realised as a core barrel as indicated in the introduction, and which further comprises at least one spacer element which is housed inside the outer assembly, bearing on the one hand against a bearing surface of one of said inner and outer assemblies and on the other hand against the rolling bearing, the restoring member being a spring member that axially biases said rolling bearing away from the bearing surface.

The spring member, which is preferably prestressed, has the effect, when axial vibrations of the inner assembly occur, of absorbing these vibrations and therefore filtering them.

According to one embodiment of the invention, the spacer element comprises an upstream tubular part which bears against an aforementioned outer tube, and a downstream tubular part which bears against an aforementioned rolling bearing, said spring member being arranged between these upstream and downstream tubular parts, bearing against each of them and acting thereon axially so as to move them apart, the spacer element additionally comprising retaining features which limit the moving-apart thereof.

The terms upstream and downstream in the context of the present invention are to be understood as a function of the core drilling direction, an upstream position or element being closer to the surface and a downstream position or element being closer to the bottom of the core hole. The spring member advantageously consists of spring washers. The latter are preferably arranged so that all the spring washers exert an elastic stress both in the upstream direction and in the downstream direction. Other known spring member can of course be envisaged, for example a helical spring.

According to one advantageous embodiment of the invention, one of said upstream and downstream tubular parts has a female tubular end piece and the other has a male tubular end piece capable of sliding axially inside a cavity of the female tubular end piece, and the spring member is housed at the bottom of said cavity, bearing against the male end piece pushed into the female end piece. The spacer element is in this way in an advantageously compact form.

Said retaining features, which limit the moving-apart described above, advantageously comprise a plurality of elongate slots provided in the axial direction in the female tubular end piece and locking elements fixed to the male tubular end piece so as to protrude radially into said elongate slots and to lock a predetermined spacing of said tubular parts by bearing against one end of said elongate slots. This arrangement allows a particularly simple and robust installation of the spacer element.

According to one particularly advantageous embodiment of the invention, said holder comprises two upstream and downstream rolling bearings placed around an aforementioned inner tube and housed inside an aforementioned outer tube, the downstream rolling bearing being arranged between a downstream-facing first annular bearing surface of the inner tube and an upstream-facing annular stop surface of the outer tube, whereas the upstream rolling bearing is arranged between an upstream-facing second annular bearing surface of the inner tube and said spacer element, said first and second annular bearing surfaces of the inner tube being located between the two rolling bearings.

The particular arrangement of an inner tube biased axially in the downstream direction by a spring member and clamped between two rolling bearings makes it possible to eliminate almost all the threads which, in the prior art, were necessary to ensure the connection between the outer assembly and inner assembly. This results in an item of equipment which is particularly robust and resistant to vibrations. The inner tube remains in a very stable position, correctly aligned axially by the two rolling bearings.

Advantageously, said first and second annular bearing surfaces of the aforementioned inner tube are provided on an annular flange which protrudes radially therefrom, and this annular flange is clamped between the upstream rolling bearing, spaced apart from the outer assembly under the spacing action of the spring member of the spacer element, and the downstream rolling bearing which is retained by the annular stop surface of the outer tube.

According to one particular embodiment of the invention, the aforementioned outer tube is composed of two upstream and downstream sections which are screwed to one another, the spacer element bears between said upstream section and said upstream rolling bearing, and the downstream section has said annular stop surface on which the downstream rolling bearing bears. In this way, due to the clamping which results from screwing these two upstream and downstream sections together, the spring force of the spring member of the spacer element is automatically applied to the inner assembly at a specific value which can be predetermined.

According to one embodiment of the invention, said inner tube of the inner assembly is held by said holder inside the outer assembly at an upstream end, and, at its downstream end, it has an outer thread capable of cooperating with an inner thread of another inner tube of the inner assembly in order to fix this inner assembly in an axially adjusted manner in a position of use.

The inner assembly can thus be adjusted to a suitable depth relative to the outer assembly in order to remove the core, by using just one single connecting thread, which greatly reduces the risks of damage and jamming.

Since unscrewing may occur under the effect of the vibrations, advantageously the core barrel additionally comprises a threaded locking nut, arranged on said outer thread of said downstream end of said inner tube, upstream of the other inner tube, and, in said position of use, this locking nut is clamped to a predetermined clamping torque against said other inner tube. Preferably, the core barrel additionally comprises a locking washer which, in said position of use, is clamped around said threaded downstream end of said inner tube, between a threaded locking nut and said other inner tube, this locking washer being arranged in such a way as to prevent any unscrewing of the nut and of said other inner tube on said threaded downstream end. Such a system, which is effective, safe, compact and easy to use, ensures that the clamping stress of the locking nut is maintained throughout the entire core drilling process. This stress is constant and permanent throughout the entire core drilling process. It therefore ensures the filtration of the cyclic stresses associated with the aforementioned axial vibrations, thereby considerably attenuating the risks of wear of the aforementioned connecting thread due to a mechanical fatigue phenomenon.

Other details and particular features of the invention will emerge from the description of an exemplary embodiments of the invention, said description being given below by way of example only, with reference to the appended drawings, in which:

FIGS. 1A and 1B together show a view in axial section of an embodiment of a core barrel according to the invention;

In the various figures, identical or analogous elements are denoted by the same references.

Figure 1B:
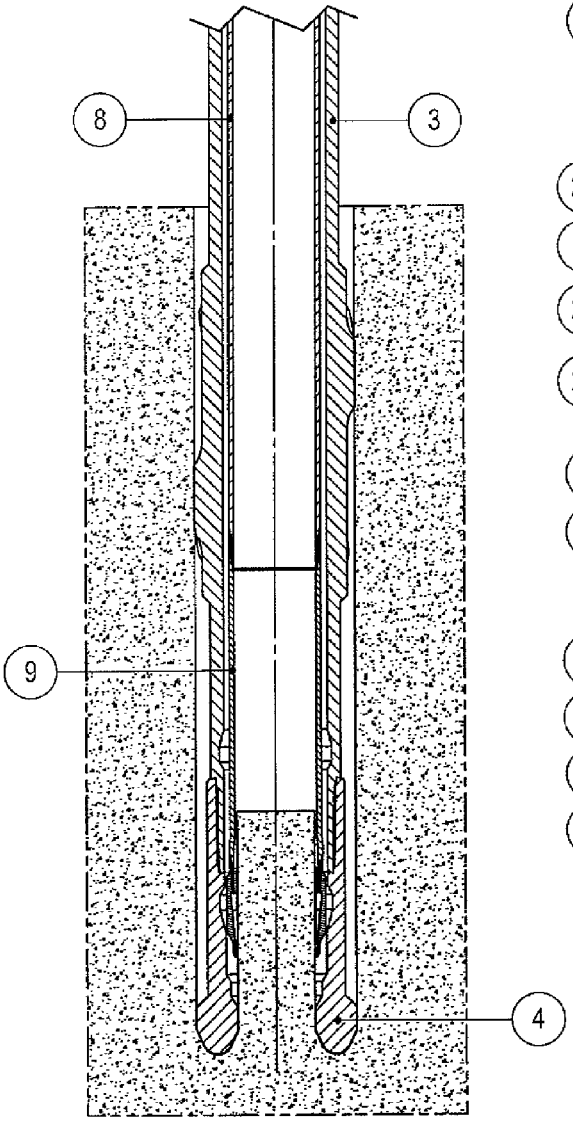
Figure 1A:
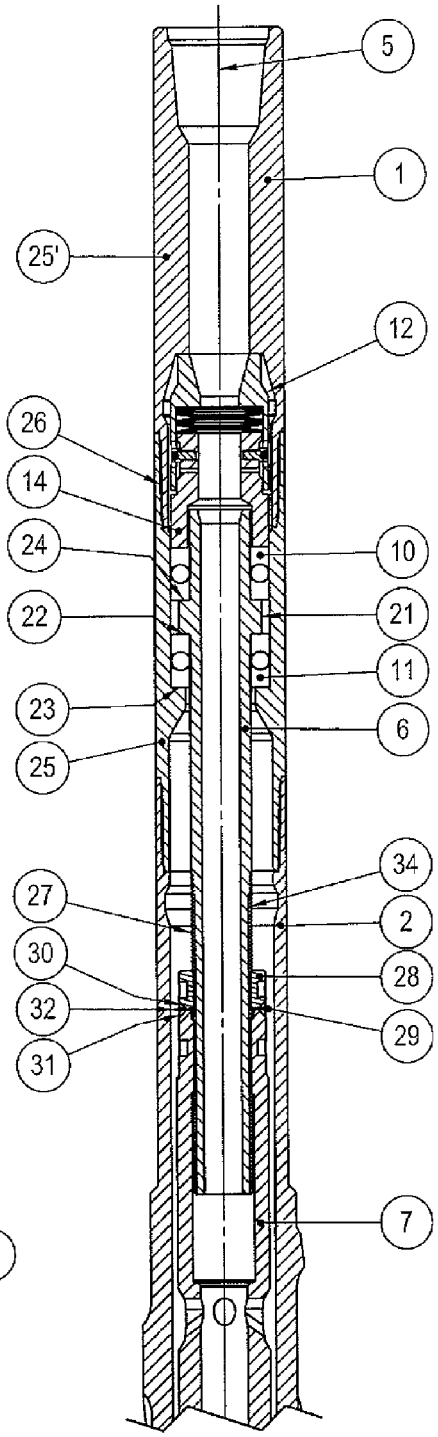

The core barrel shown in FIGS. 1A and 1B comprises an outer assembly formed of a plurality of outer tubes 1, 2 and 3 which are screwed to one another, and of a core bit 4. From the surface, this outer assembly is driven in rotation about the axis 5. The core barrel additionally comprises an inner assembly formed of a plurality of inner tubes 6, 7 and 8 which are screwed to one another, and of core removal elements 9 which are known and are shown schematically. Finally, a holder, in the illustrated example two upstream and downstream roller bearings 10 and 11, are provided for holding the inner assembly in the outer assembly. In this way, these assemblies are reciprocally free in rotation, and the inner assembly remains fixed in rotation while the outer assembly turns about its axis. It would also be possible to provide more than two rolling bearings, or even just one, between the two assemblies.

Figure 2:
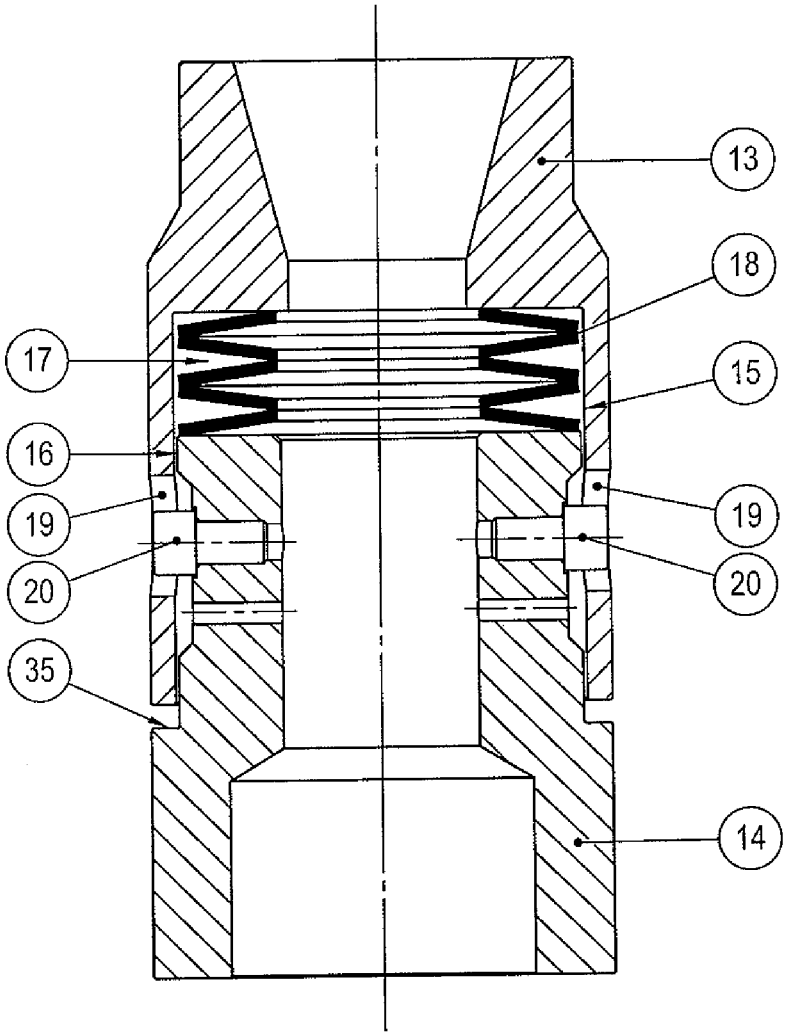
FIG. 2 shows a view in axial section of a spacer element used in the embodiment of FIGS. 1A and 1B.

According to the example of embodiment shown in FIGS. 1A and 1B, the core barrel additionally comprises a spacer element 12 which is shown in detail in FIG. 2.

The spacer element 12 is housed inside the outer tube 1. In the illustrated example, it comprises an upstream tubular part 13 which bears against the outer tube 1 and a downstream tubular part 14 which bears against the upstream rolling bearing 10. In this example, the upstream tubular part 13 is provided with a female tubular end piece 15 while the downstream tubular part 14 has a male tubular end piece 16 which is capable of sliding axially inside the cavity 17 of the aforementioned female end piece.

In the illustrated example of embodiment, a spring member 18 formed of a plurality of stacked frustoconical spring washers is housed at the bottom of the cavity 17 of the upstream tubular part 13, bearing against the male tubular end piece 16 pushed into the female tubular end piece 15.

Retaining features limit the possibilities of moving apart and, in the illustrated case, simultaneously of bringing together the upstream and downstream tubular parts 13 and 14. These retaining features consist here of a plurality of elongate slots 19 provided in the axial direction on the female tubular end piece 15, and of locking elements 20, in the form of bolts for example, which are screwed into the male tubular end piece 16 so as to protrude radially into the elongate slots 19. The ends of the elongate slots 19 serve as a stop for the locking elements 20 and thus limit a moving-apart of the two parts of the spacer element, beyond a predetermined value. A shoulder 35 is provided on the downstream tubular part 14 so as to prevent the parts 13 and 14 from being brought closer together beyond a certain limit.

By virtue of this arrangement, the axial vibrations which may occur as the core barrel passes through hard geological layers are effectively absorbed and damped by the spacer element.

As can be seen from FIGS. 1A and 1B, the holder for holding the inner assembly in the outer assembly advantageously comprise, as indicated above, two upstream and downstream rolling bearings 10 and 11 which are placed around the inner tube 6, in particular around the upstream end thereof, and are arranged inside the outer tube 1.

In this example of embodiment, the inner tube 6 carries close to its upstream end an annular flange 21 which protrudes radially therefrom. This flange is clamped between the two rolling bearings 10 and 11. The downstream rolling bearing 11 is housed between the downstream-facing annular bearing surface 22 of the flange 21 and an annular stop surface 23 of the outer tube 1. The upstream rolling bearing is arranged between the upstream-facing annular bearing surface 24 of the flange 21 and the spacer element 12, in particular the downstream tubular part 14 thereof. The spring member, by exerting its spacing action between the upstream and downstream tubular parts 13 and 14 of the spacer element, has the effect of pushing in the downstream direction the two rolling bearings 10 and 11 and the flange clamped between them, the downstream rolling bearing 11 being retained by the annular stop surface 23 of the outer assembly.

Thus, in the case where the inner assembly ascends towards the surface under the effect of axial vibrations, it can be imagined that the downstream rolling bearing 11 may no longer be in contact with the annular stop surface 23 or the annular bearing surface 22, or even risks being dislocated due to a disconnection of the elements constituting this downstream rolling bearing 11. However, according to the invention, the upstream rolling bearing 10 takes over while, in addition, the spring member tends to oppose this ascent.

As can be seen from FIGS. 1A and 1B, in the illustrated example of embodiment, the outer tube 1 is composed of two downstream and upstream sections 25 and 25'. These two sections are joined to one another by a robust thread 26. The downstream section 25 has the upstream-facing annular stop surface 23. By a suitable screwing of these two sections 25 and 25', it is possible to adjust automatically the return force of the spring member 18 to an appropriate specific value.

In the example of embodiment shown in FIGS. 1A, 1B, 3 and 4, the core barrel comprises, in a known manner, a system for adjusting the depth position of the inner assembly relative to the outer assembly. At its upstream end, the inner tube 6 is held by the rolling bearings 10 and 11 inside the outer assembly. At its downstream end, it has an outer thread 27 capable of cooperating with an inner thread of the next inner tube 7. This arrangement makes it possible to fix the inner assembly at an adjustable depth relative to the outer assembly. It should be noted that, in this embodiment, there is a single thread, the outer thread 27, for forming the connection between the outer assembly and the inner assembly, and for adjusting the position of use of the core barrel. The structure is therefore greatly simplified compared to the core barrels according to the known prior art, which minimises the possibilities for damage.

The outer thread 27 is preferably specially designed to be on the one hand robust, so as to minimise the risks of wear on the thread, and on the other hand particularly long, so as to have an extended adjustment length for the inner assembly relative to the outer assembly.

In order to prevent any unscrewing from occurring on the adjustment system between the inner tubes 6 and 7 under the effect of the vibrations, it is provided according to the invention to arrange a locking nut 28 which is screwed onto the inner tube 6, upstream of the inner tube 7. Once the position of the inner assembly relative to the outer assembly has been adjusted, it is then possible to screw the locking nut 28 against the inner tube 7 to a predetermined clamping torque. This nut substantially prevents any unscrewing of the inner tubes 6 and 7 associated with the vibrations, and thus reduces the causes of damage or breakage of the outer (adjustment) thread 27.

Figure 3:
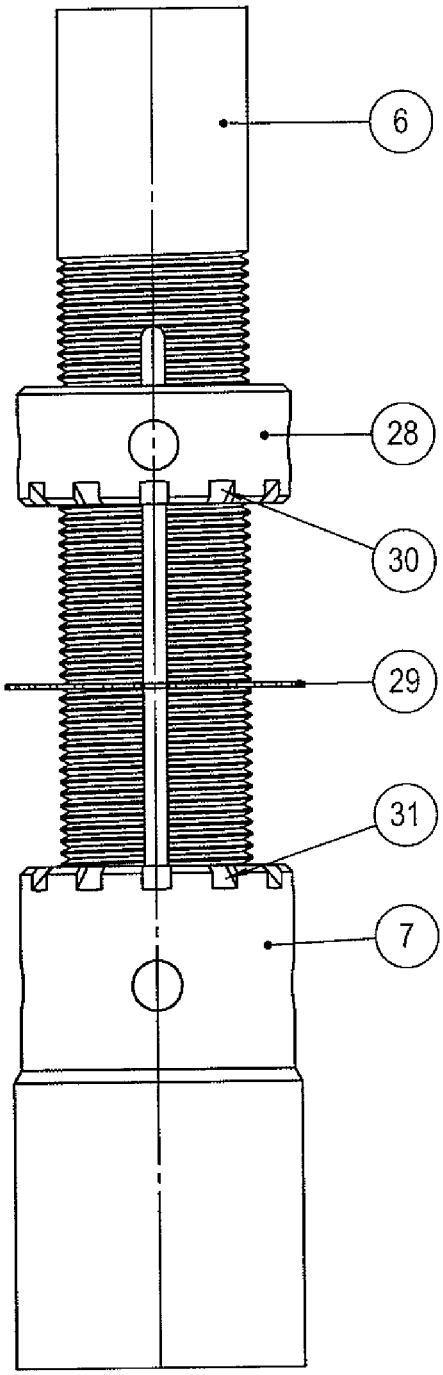
FIGS. 3 and 4 show the installation of an embodiment of a system for adjusting the position of the inner assembly relative to the outer assembly of a core barrel according to the invention.
Figure 4:
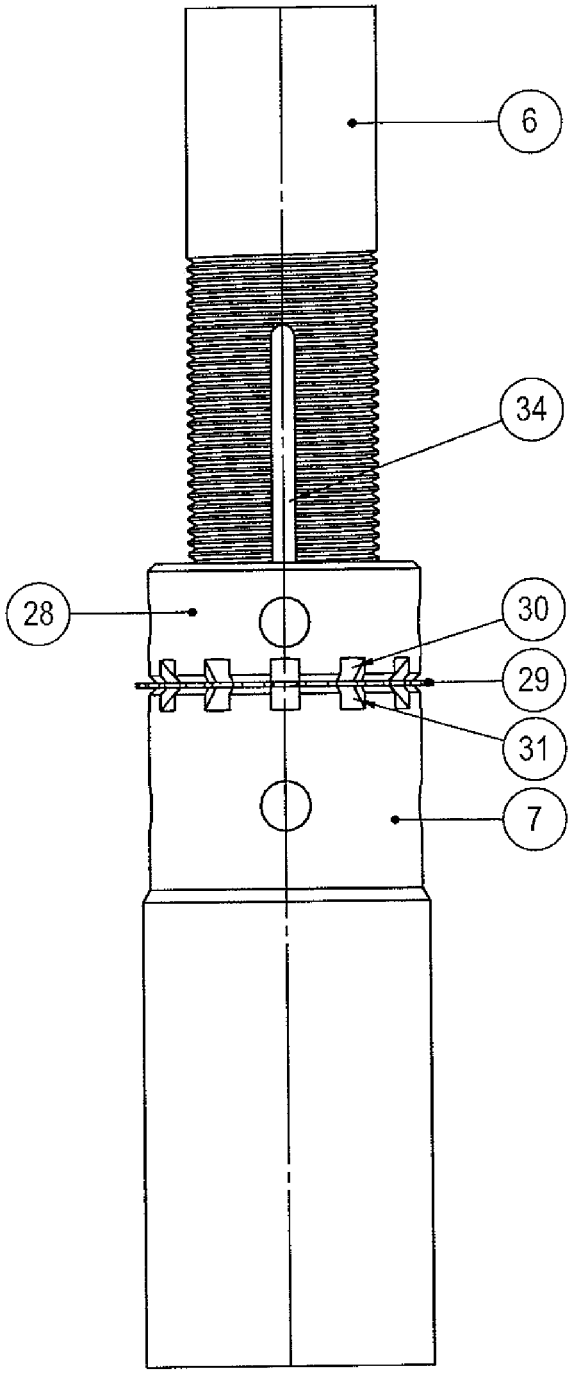
Figure 5:
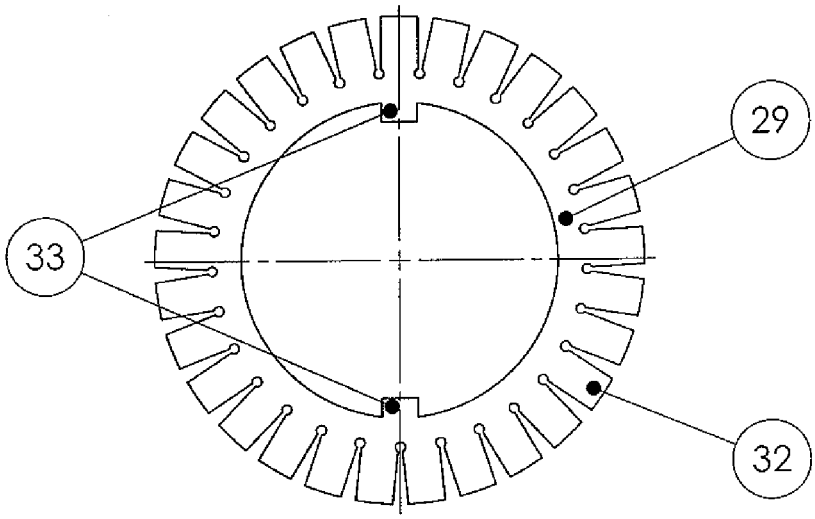
FIG. 5 shows a plan view of a locking washer of the adjustment system of FIGS. 3 and 4.

Advantageously, as shown in detail in FIGS. 3 to 5, it is possible to provide a locking washer 29 which, in the position of use of the core barrel, is clamped between the locking nut 28 and the upstream end of the inner tube 7. This washer is preferably arranged so as to prevent any unscrewing of the locking nut 28 and of the inner tube 7. In the illustrated example, the locking nut 28 has peripheral notches 30 and the upstream end of the inner tube 7 has peripheral notches 31. The locking washer 29 has corresponding tabs 32 around its periphery. In the screwed position, some of the tabs can be folded in the upstream direction into the notches 30 and some can be folded in the downstream direction into the notches 31, thus preventing any separation movement between the locking nut 28 and the inner tube 7.

In order that said washer is secured to the inner tube 6 in the angular position while remaining free in terms of axial displacement, two inner tabs 33 have been added to the washer 29 so as to be housed in two axial recesses 34 provided for this purpose on the inner tube 6. As soon as tabs 32 are engaged in the inner tube 7 and the locking nut 28, these latter elements 7 and 28 are thus advantageously held in an angularly fixed manner relative to the inner tube 6.

It has also been found that, with a core barrel as designed according to the invention, it became possible to eliminate the seals which were usually required. Even the lubrication of the outer adjustment thread 27 has in fact been found to be unnecessary, and therefore a lubrication chamber at this location has turned out to be superfluous. This therefore results in an increased reliability of the system, and it is thus possible to suppress the temperature limits for use of the core barrel in view of the omission of seals made from rubber or plastomer material.

It must be understood that the present invention is in no way limited to the embodiment described above and that many modifications can be made thereto within the scope of the appended claims.

Figure 6:
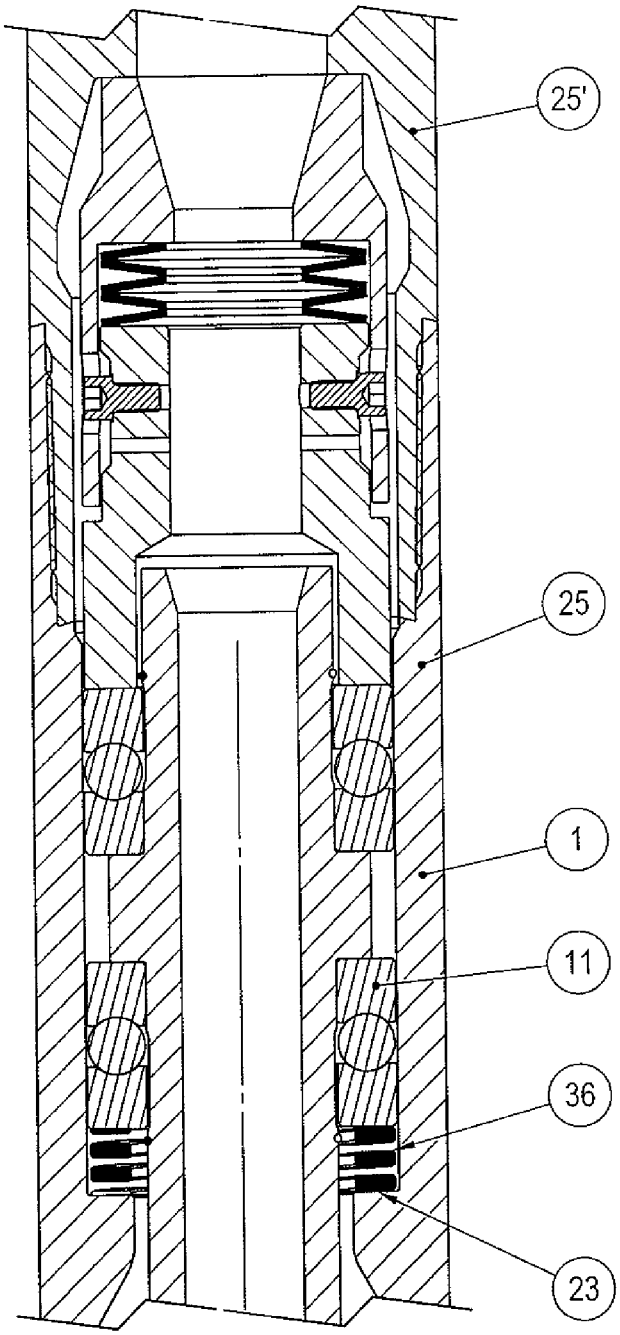
FIG. 6 shows a partial view in axial section of a variant embodiment of a spacer element as may be used in a core barrel according to the invention.

For example, according to one advantageous embodiment of the invention, there can be envisaged a core barrel comprising an additional spacer element 36, as shown in FIG. 6. The core barrel of FIG. 6 is identical to the core barrel of FIGS. 1 to 5, except in the respects illustrated in FIG. 6 and as described below.

As stated, the embodiment of FIG. 6 has additional spacer element 36. In this example of embodiment, the additional spacer element is a helical spring. The additional spacer element is to be inserted between the downstream rolling bearing 11 and the upstream-facing annular stop surface 23 of the outer tube 1. When the two sections 25 and 25' of the outer tube 1 are screwed together, the spring is prestressed, which makes it possible to produce a vertical force, directed upwards, on the downstream rolling bearing 11 and to keep the elements of this rolling bearing 11 in compression, so that they remain secured. In the event of upward axial displacement of the inner assembly, the downstream rolling bearing 11 is accompanied in this displacement and it is not subject to any impact upon once again making contact with the stop surface 23.

Although the above description has been made predominantly with respect to a core barrel, the invention may find application in other drilling apparatus where it is desired to provide axial damping between relatively rotatable tubular members, and in cases where it is desirable to be able to securely adjust the length and/or relative position between threadedly connected tubular members, such as drill string components and related equipment, for example in a bottom hole assembly.

The invention claimed is:

1. A drilling apparatus comprising:

an outer tubular assembly;

an inner tubular assembly at least partially within the outer tubular assembly;

a drill bit operably connected to one of the outer tubular assembly or the inner tubular assembly; and a spacer element housed within the outer tubular assembly, the spacer element including:

an upstream tubular part coupled to the outer tubular assembly and including a female tubular end piece, the upstream tubular part configured to apply a first axial force on the outer tubular assembly in response to a relative displacement of the outer tubular assembly with respect to the inner tubular assembly; and a downstream tubular part coupled to the inner tubular assembly and including a male tubular end piece positioned in the female tubular end piece, the downstream tubular part configured to apply a second axial force opposite to the first axial force on the inner tubular assembly in response to the relative displacement in order to maintain an axial position of the inner tubular assembly relative to the outer tubular assembly.

2. The drilling apparatus of claim 1, wherein the drill bit is a core bit operably connected to the outer tubular assembly, and the inner tubular assembly includes a core removal element.

3. The drilling apparatus of claim 1, wherein the spacer element further includes a spring member arranged between the upstream tubular part and the downstream tubular part, the spring member configured to:

bear against the upstream tubular part to apply the first axial force onto the upstream tubular part in response to the relative displacement; and bear against the downstream tubular part to apply the second axial force onto the downstream tubular part in response to the relative displacement.

4. The drilling apparatus of claim 3, wherein the spring member comprises spring washers.

5. The drilling apparatus of claim 3, wherein:

one of the upstream tubular part or the downstream tubular part includes a female tubular end piece and the other tubular part includes a male tubular end piece configured to slide axially into the female tubular end piece; and the spring member is housed within the female tubular end piece and bears against the male tubular end piece and the female tubular end piece.

6. The drilling apparatus of claim 1, wherein the spacer element further includes a retaining feature including:

an elongate slot extending axially along one of the upstream tubular part or the downstream tubular part; and a locking element protruding radially from the other tubular part into the elongate slot, the locking element configured to:

move along the elongate slot to allow movement of the upstream tubular part with respect to the downstream tubular part; and bear against an end of the elongate slot to limit an extent of the movement of the upstream tubular part with respect to the downstream tubular part.

7. The drilling apparatus of claim 1, further comprising a first rolling bearing arranged between the inner tubular assembly and the outer tubular assembly to hold the inner tubular assembly at least partially within the outer tubular assembly such that the inner tubular assembly and the outer tubular assembly are reciprocally free in rotation.

8. The drilling apparatus of claim 7, wherein the upstream tubular part bears against a bearing surface of the outer tubular assembly and the downstream tubular part bears against the first rolling bearing.

9. The drilling apparatus of claim 7, further comprising:

an annular flange protruding radially from the inner tubular assembly, the annular flange having an upstream bearing surface and a downstream bearing surface; and a second rolling bearing arranged between the inner tubular assembly and the outer tubular assembly to hold the inner tubular assembly at least partially within the outer tubular assembly such that the inner tubular assembly and outer tubular assembly are reciprocally free in rotation;

wherein the first rolling bearing is further arranged between the upstream bearing surface of the annular flange and the downstream tubular part of the spacer element, and the second rolling bearing is further arranged between the downstream bearing surface of the annular flange and an annular stop surface protruding from the outer tubular assembly.

10. The drilling apparatus of claim 9, wherein the outer tubular assembly includes:

a downstream section having the annular stop surface against which the second rolling bearing bears; and an upstream section having a bearing surface against which the spacer element bears, the upstream section configured to be coupled to the downstream section by threading the upstream section and the downstream section together to prestress a spring member included in the spacer element, the prestressing of the spring member adjusting the first axial force and the second axial force applied by the spacer element.

11. The drilling apparatus of claim 9, further including a spring member arranged between the second rolling bearing and the annular stop surface of the outer tubular assembly to axially bias the second rolling bearing away from the annular stop surface.

12. The drilling apparatus of claim 1, wherein the inner tubular assembly includes:

a first tube with an upstream end and a downstream end, the first tube at least partially within the outer tubular assembly proximate the upstream end and having an outer thread proximate the downstream end; and a second tube having an inner thread configured to cooperate with the outer thread to threadedly couple the second tube partially onto the first tube, the coupling of the second tube partially onto the first tube allowing an assembled length of the first tube and the second tube to be adjusted.

13. The drilling apparatus of claim 12, further comprising a threaded locking nut arranged on the outer thread of the first tube and rotated to be proximate the second tube threadedly coupled partially onto the first tube to maintain the assembled length of the first tube and the second tube.

14. The drilling apparatus of claim 12, further comprising:

a threaded locking nut arranged on the outer thread of the first tube; and a locking washer arranged on the outer thread of the first tube between the threaded locking nut and the second tube, the locking washer having a locked configuration to maintain the assembled length of the first tube and the second tube by preventing the second tube from further threading onto or unthreading from the first tube.

* * * * *